US005915908A

United States Patent [19]

Beutler

[11] Patent Number: 5,915,908

[45] **Date of Patent: *Jun. 29, 1999**

[54] SYSTEM FOR ACCOMMODATING, TEMPORARILY STORING AND OUTPUT OF MOVABLE OBJECTS

[75] Inventor: Hans Beutler, Munich, Germany

[73] Assignee: Friedrich Maurer & Söhne Gmbh & Co. KG, Munich, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/646,313

[22] PCT Filed: Jul. 10, 1995

[86] PCT No.: PCT/EP95/02679

§ 371 Date: Jul. 17, 1996

§ 102(e) Date: Jul. 17, 1996

[87] PCT Pub. No.: WO96/08624

PCT Pub. Date: Mar. 21, 1996

[30] Foreign Application Priority Data

Sep. 16, 1994 [EP] European Pat. Off. ..... 9403113

[51] Int. Cl.[6] ..... B65G 1/00

[52] U.S. Cl. ..... 414/263

[58] Field of Search ..... 414/253, 254, 414/259, 261, 262, 263

[56] References Cited

U.S. PATENT DOCUMENTS

| | | | |
|---|---|---|---|
| 2,691,448 | 10/1954 | Contz | 414/263 |
| 3,414,141 | 12/1968 | Rougemont | 414/262 |
| 3,419,162 | 12/1968 | Hagel . | |
| 3,437,218 | 4/1969 | Hagel | 414/253 |
| 3,474,918 | 10/1969 | Postmes et al. | 414/263 |
| 3,513,992 | 5/1970 | Handler | 414/259 |
| 4,039,089 | 8/1977 | Kochanneck | 414/263 |
| 4,264,257 | 4/1981 | Saurwein | 414/263 |
| 4,976,580 | 12/1990 | Knakrick | 414/256 |
| 5,090,862 | 2/1992 | Lee | 414/261 |
| 5,456,562 | 10/1995 | Schlecker et al. | 414/254 |
| 5,478,182 | 12/1995 | Hildebrand et al. | 414/261 |

FOREIGN PATENT DOCUMENTS

| | | | |
|---|---|---|---|
| 554434 | 2/1957 | Belgium | 414/259 |
| 0350464 | 1/1990 | European Pat. Off. . | |
| 0572352 | 12/1993 | European Pat. Off. . | |
| 1045075 | 10/1958 | Germany . | |
| 1094964 | 12/1960 | Germany . | |
| 1271367 | 6/1968 | Germany . | |
| 1684721 | 4/1971 | Germany . | |
| WO8801331 | 2/1988 | WIPO . | |
| WO9112396 | 8/1991 | WIPO . | |

*Primary Examiner*—Thomas J. Brahan

*Attorney, Agent, or Firm*—Birch, Stewart, Kolasch & Birch, LLP

[57] ABSTRACT

A system for accommodation, temporary storage and delivery of movable objects, pilotless, movable vehicles in particular, includes a tender (5) supported rotatably about a central axis, by which tender the vehicles are taken over from at least one entry platform (E) and are placed on a free one out of a plurality of platforms (3) or again are picked up therefrom and are handed over to an exit platform (A). The tender (5) therein includes at least two carrier arms (6) one of which being correlated to an entry platform (E) in entry and exit position of the tender and one carrier arm being correlated to an exit platform (A). Depending on the local situation the entry and exit platforms (E, A) can be embodied and arranged differently. They can also be formed as combined entry/exit platforms (E/A) for permitting adaption to varying demands.

5 Claims, 5 Drawing Sheets

FIG. 6
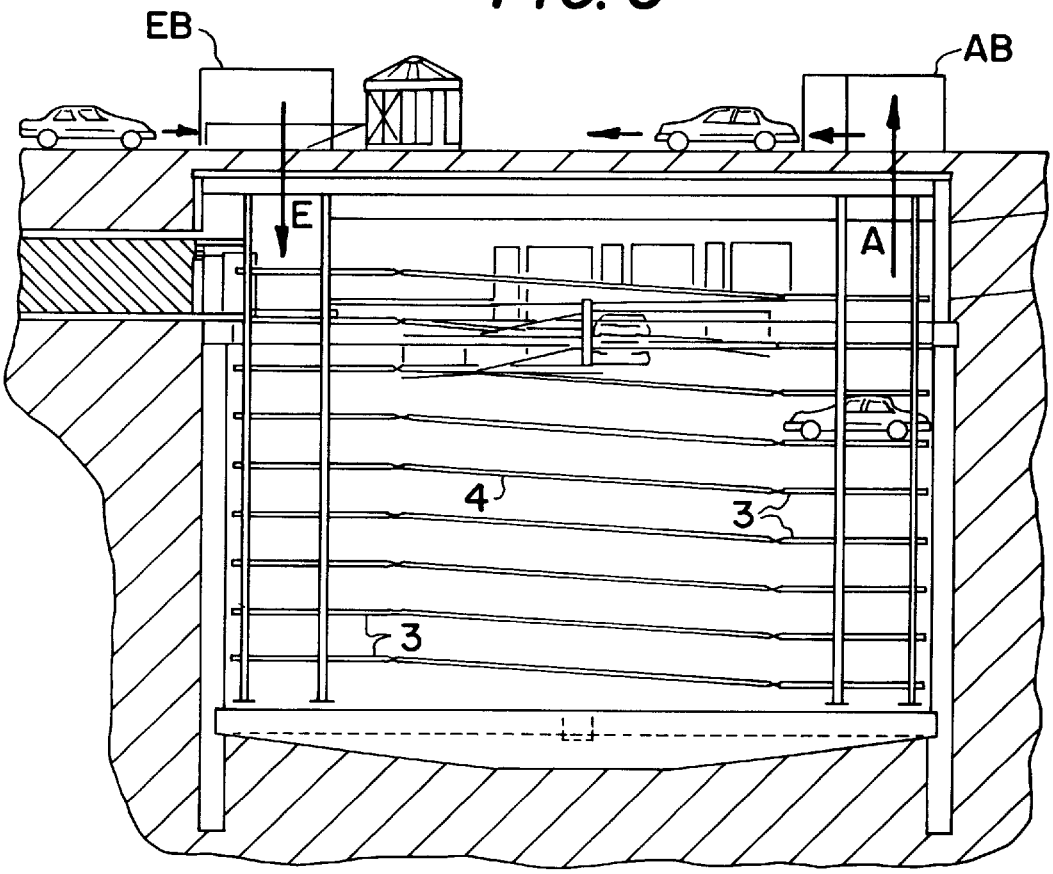
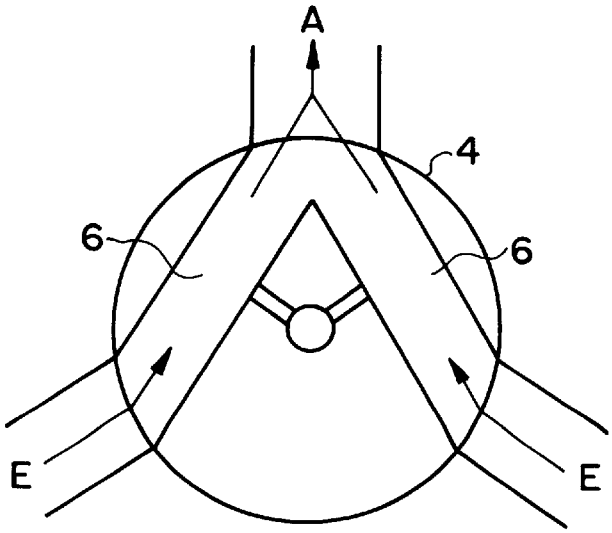
FIG. 7

SYSTEM FOR ACCOMMODATING, TEMPORARILY STORING AND OUTPUT OF MOVABLE OBJECTS

BACKGROUND OF THE INVENTION

FIELD OF THE INVENTION

The invention relates to a system for accommodation, temporary storage and output of movable objects, in particular of pilotless locomotive vehicles.

In such a system which is subject of the application PCT/EP94/03113, vehicles are taken over from at least one entry platform by means of a transfer device of a tender rotatably supported about a central axis and comprising at least one carrier arm. Each vehicle is taken from a parking platform over to an exit platform, wherein the platforms are arranged one beside the next in radial direction along a helical rail for the tender. The transfer device supported on the carrier arm of the tender therein comprises a frame device which can be moved in longitudinal direction between the wheels of a vehicle standing on a platform. The frame device includes at least four support arms extending rectangularly towards the vehicle wheels. At least two of said support arms are pivotable from a position directed in direction of said frame device into the rectangularly extended position in which the arms bear on the bottom area of the respective vehicle under pressure and lift it from the parking surface.

The efficiency of a parking plant depends upon the number of entering and leaving vehicles, which can be taken and delivered per unit time. Thus it is possible to provide a tender with only one carrier arm which depends upon request transfers, where a vehicle is moved to a platform or from a platform to the exit platform. Such an arrangement, however, only is suitable for small-size parking place capacities where a demand for parking spaces essentially remains constant over the course of time. In larger-scale plants, account has to be taken for rush operation or a temporal change between prevailing entry and exit operations. Thus, in an urban parking plant during the morning, mainly entry operations will occur while at the time of closing exit operations will prevail. Similarily, upon the end of theater or concert performances or similar events strong exit traffic will occur in the parking plant.

SUMMARY OF THE INVENTION

The invention is based on the object of designing a system where the operation can be optimized and adapted to different loads and operating conditions.

For solving said object, the tender in general comprises at least two carrier arms of which in entry and exit positions of the tender, one carrier arm is aligned with an entry platform and one carrier arm is aligned with an exit platform. In this way, it is possible to simultaneously take over a vehicle from an entry platform to a carrier arm and to deliver a vehicle to an exit platform from the other carrier arm.

In case of the tender equipped with two carrier arms, those preferably are arranged diametrally opposing each other, whereas four carrier arms preferably have an angle of 90° between one another. In the latter case, the entry and exit platforms are disposed on the periphery of a circle with mutual angular distances of 90°.

The capacity of the plant can be further increased if more entry and exit platforms than carrier arms are provided for. The carrier arms then can be aligned with entry and exit platforms at different angular positions and the entry and exit platforms which are not in connection with a carrier arm can be loaded or emptied during this time. The entry and/or exit platforms, respectively, therein preferably are arranged one beside the other for permitting quick loading of each platform.

Flexibility of the plant can be further increased by providing some of the entry and exit platforms which are equipped for selective use as entry platforms or as exit platforms or a built to be modified to selective use. It is also possible to make the individual carrier arms adjustable in their angular position such that in one position of the tender each carrier arm selectively can be aligned with at least two entry and/or exit platforms, respectively.

Depending on size and required efficiency of the plant one or several tenders, in particular two tenders, can be provided, wherein in the latter case the two tenders are displaceable independently from one another. The entry and exit platforms therein can either be aligned with both tenders together or separate entry and exit platforms are provided for each tender.

In larger-scale plants it is recommendable to arrange the entry and exit platforms between the upper and the lower ends of a helical rail for the tenders in such way that one tender can be moved to the platforms located above the entry and exit platforms and the other tender is movable to the platforms located below the entry and exit platforms. In such a parking plant the platforms located above the entry and exit platforms are arranged in an overground (multi-storey) car park and the platforms located below the entry and exit platforms are located in an underground parking garage.

For contruction reasons two tenders of differing diameters are used which are movable on corresponding rails separately or together. The overground parking garage therein can be designed where it is smaller than the underground parking garage. Therein it also is possible to use tenders of different sizes or with variable lengths of the carrier arm.

The carrier arms can be radially arranged with respect to the rail circle or as chord. In case of an arrangement with chords, a position would be possible in which the vehicles are picked up on one end of the carrier arm and are delived from the other end again. This provides the advantage that the vehicle at a later time can be delivered to the exit platform in a forward direction. In such a case it is provided for advantageously that the transfer device supported on each carrier arm can be charged and decharged from both sides. In such an arrangement, several carrier arms of a tender are disposed one on top of the other and at different heights displaced with respect to one another, wherein a minimum height must not be remained under.

Depending on the local situation, the entry and exit platforms are arranged on the level of the approach roads approximately or they are arrranged below or above the level of the approach paths, wherein then at least one entry and exit box connected to an entry and/or exit platform, respectively, by a vehicle elevator is arranged in the level of approach ways.

Providing separate entry and exit boxes as kind of deliverer for the entry and exit platforms permits vehicles to drive in or out in forward direction.

A common vehicle elevator can be provided for as common entry and exit platform, by means of which vehicles are transferred from the level of appraoch ways to the level of the respective carrier arm.

In a further embodiment of the invention, special platforms may be provided for vehicles whose height exceeds that of a passenger car, e.g. transporters or camping cars, the cross-section of the special platforms being adapted to such vehicles. In order to reliably move such vehicles to the respective platforms, a means for automatically detecting the vehicle height prior to the entry is provided.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 6 shows the correlation of the entry and exit boxes with an underground plant; and FIG. 7 shows a tip view of a tender whose carrier arms are charged and decharged in a forward direction of the vehicles.

DETAILED DESCRIPTION OF THE PREFERRED EMBODIMENTS

Figure 1:
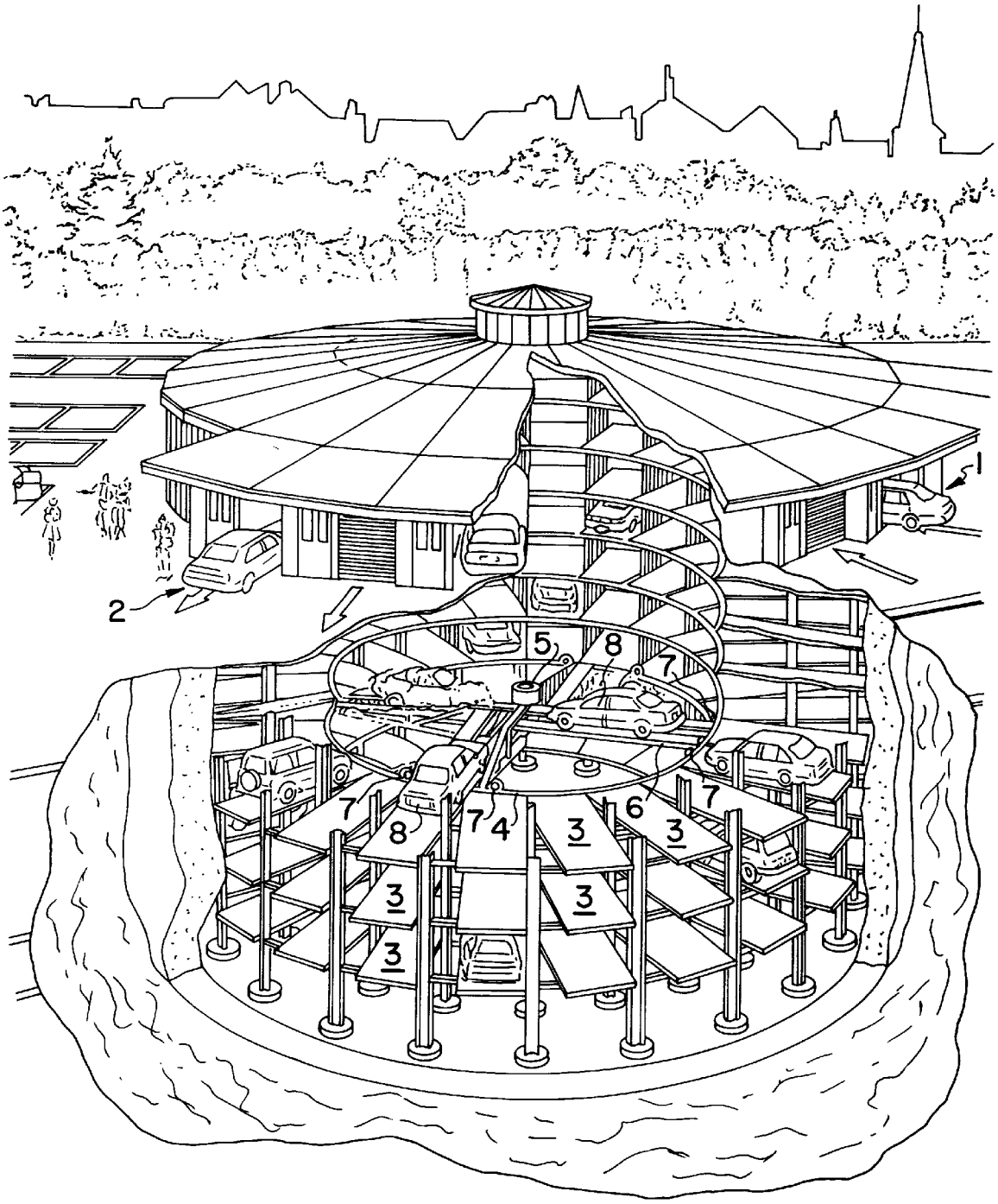
FIG. 1 is a partly broken perspective view of a plant in accordance with the invention with partly occupied platforms.

The plant shown in FIG. 1 forms a parking garage located below ground, which in its basic structure is formed as hollow cylinder. In the overground part the entry is located at 1 and the exit is located at 2. A plurality of parking places 3 which in their longitudinal direction are arranged radially and which with their radially outer ends are adjacent to the inside wall of the hollow cylinder and are arranged in the interior of the hollow cylinder. The parking places 3 are arranged along a helical line so that they lie one beside the other without interruption from the first up to the last and from the uppermost, respectively, to the lowestmost parking place. In the shown example, the helical line has a uniform diameter. It can, however, also be provided for that two parking garages of different sizes with helical lines of different diameters are located one above the other. Helical lines with different diameters are travelled on by different tenders 5 or the tenders are provided with carrier arms 6 adjustable in length.

On their radially inner side the parking places are connected with one another by a rail 4 which correspondingly also extends helically.

In the inside cylindrical space not occupied by the parking places 3 a so-called tender 5 having four carrier arms 6 is arranged. Each of the carrier arms of the tender is supported on the rail 4 by means of two running wheels 7 each. On the four arms of the tender 5 four vehicles 8 can be in common transported in upward or downward, respectively, directions. The tender 5 turns about his own axis during lifting or lowering operations so that each of the four arms can go to a parking place or an entry or exit platform, respectively.

On each carrier arm 6 a transfer device is located which by means of a frame shiftable under the vehicle lifts said vehicle, displaces it onto the carrier arm and upon moving of said carrier arm transfers it to the platform of a parking place. This operation and the respective reverse operation during leaving the parking place is automatically effected by means of a control without a service person having to interfere. The vehicle therein is not occupied. The transfer device and the relating control are not subject of the present invention and, therefore, are not shown and explained in detail.

For transferring the vehicle to a carrier arm 6, it has to be brought in a given position by the driver. An entry platform which is located behind the entry 1 and on which the vehicle is guided into the correct position by means of guide rails serves for this purpose. When this position is reached the driver and other possible passengers by means of a visual indication are called to leave the vehicle. If required, it can be automatically detected by suitable measurements where no person is in the vehicle still.

An exit platform to which a vehicle is transferred upon request by the driver is located at the exit 2.

Figure 2:
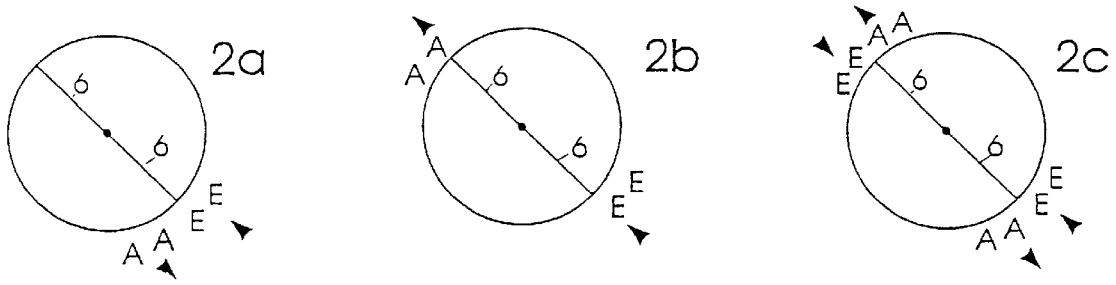
FIGS. 2, 3 and 4 are schematic cross-sectional views of the plant in the plane of the entry and exit platforms.
Figure 3:
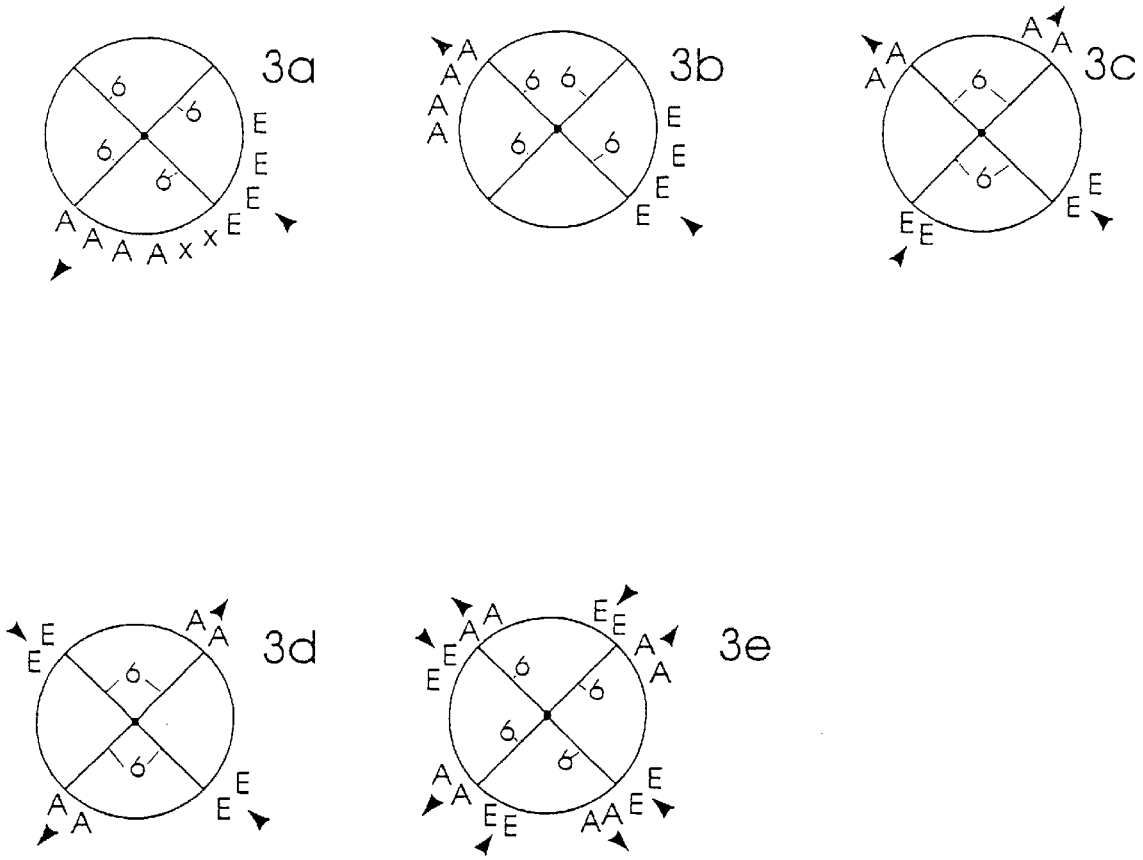

Depending on the local situation and the demanded efficiency of the plant, i.e. entry and exit operations possible per unit time (per hour), the carrier arms 6 and the entry and exit platforms can be shaped and arranged differently. FIGS. 2 to 4 schematically show a cross-section of the plant in the plane of the entry and exit platforms, the entry platforms being referred to by E and the exit platforms—by A. The moving direction of the vehicles is shown by arrows.

FIG. 2 shows a plant with a two-arm tender 5. The two carrier arms 6 therein are arranged diametrally opposingly.

According to FIG. 2*a,* two entry platforms E and adjacently two exit platforms A are provided for on the outer circumference of the circle of rotation of the tender 5. Thus, always only one of the carrier arms 6 can be directed to one of the entry or exit platforms. The disadvantage, of a comparatively low efficiency is opposed to by the advantage the no large areas are required for approach and leaving paths. This can be of essential importance in certain cases, e.g. when the circumferential area of the plant is occupied by other buildings and is not accessible.

In FIG. 2*b* two entry platforms E are arranged one beside the other and diametrally opposingly two exit platforms A also are arranged one beside the other. In this way the one carrier arm 6 can be charged and simultaneously the other carrier arm 6 can be discharged. The entry 1 and the exit 2 of the building correspondingly are opposed to one another. This version is applicable if the local situation requires approach and leaving paths separated from one another.

For the case that the approach and leaving paths need not be separated from one another, the arrangement under FIG. 2*c* is suitable, which practically represents a duplication of the arrangement of FIG. 2*a* in that both carrier arms 6 can be charged or decharged simultaneously. In the shown example, it is provided for that in a position of the tender 5 simultaneously both carrier arms 6 can be discharged and in a displaced position both carrier arms can be charged. In corresponding position of the entry and exit platforms, however, it also is possible that one carrier arm is charged while the other is discharged.

Figure 8:
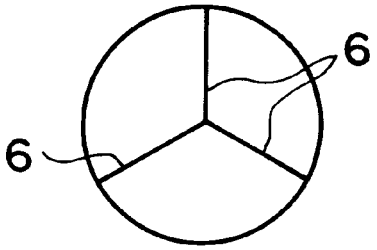
FIG. 8 shows an embodiment where three carrier arms are provided.
Figure 9:
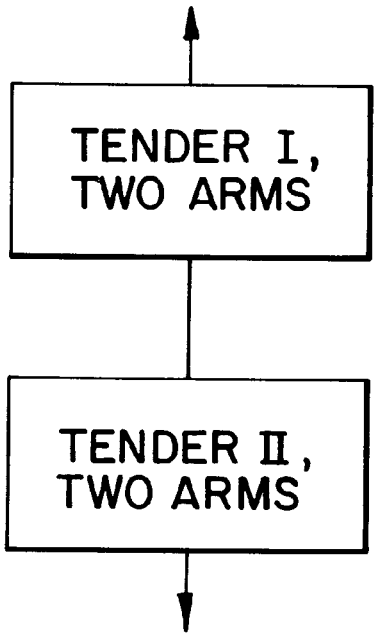
FIG. 9 shows an embodiment where two tenders are fixedly coupled with one another.
Figure 10:
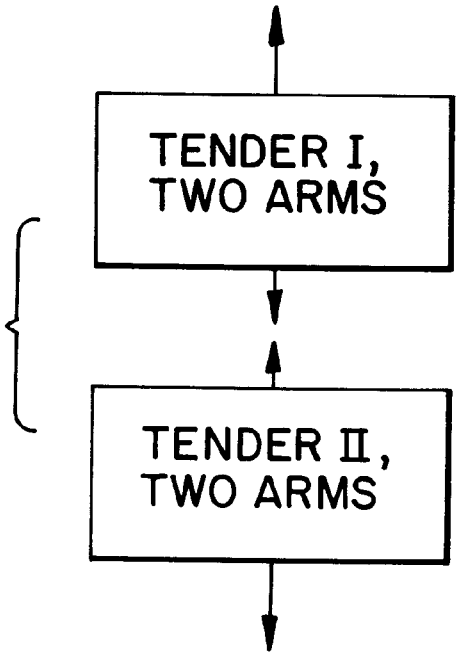
FIG. 10 shows an embodiment where two tenders are movably independent of one another.

While in the embodiment under FIG. 2 the two carrier arms 6 are aligned in a continuous radial direction, in a further embodiment shown in FIG. 8 also three carrier arms can be provided for enclosing between one another angular distances of 120° each.

A more efficient, however also more expensive embodiment results when the tender 5 has four carrier arms 6 of which two—seen in cross-section of the plant—each are opposed to one another diametrally and are displaced by 90° with respect to the other two carrier arms, so that in total a cross-shaped embodiment results as is schematically shown in FIG. 3.

FIG. 3*a* therein in principle corresponds to the arrangement under FIG. 1*a* with duplication of the number of entry and exit platforms. Of the four carrier arms 6, however, only two can be charged or discharged simultaneously. Corresponding is true for FIG. 3*b* with respect to FIG. 2*b*.

Further possibilities are shown in FIGS. 3*c*, 3*d* and 3*e*, wherein the respective specific suitability results from the representation and the explanation to FIG. 2*c* without difficulty.

The embodiment under FIG. 3 is based on a rigid alignment of the four carrier arms 6 at angular distances of 90°. In a modification not shown, however, the carrier arms can also be mutually adjustable in limited angles so that in a position of the tender 5 a carrier arm 6 can operate two adjacent entry and exit platforms.

In the embodiments described up to now the platforms are provided for either as entry platforms or as exit platforms and provided with the equipment required therefor. However, the platforms can also be designed such that they can alternatively be used as entry or exit platforms. The constructional expense therefor of course must be higher and the change requires certain change-over works; as, however, the total number of platforms in this way can be kept lower, providing such combined platforms may be economically preferable depending on the situation.

Figure 4A:
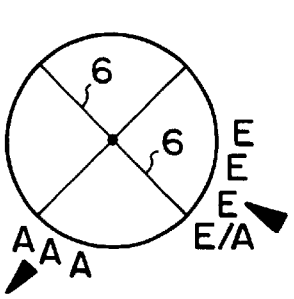
Figure 4B:
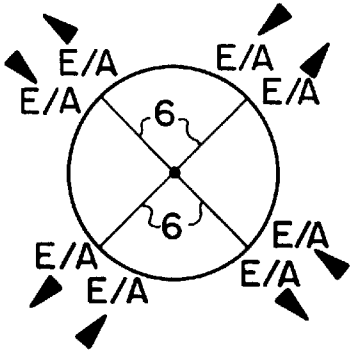
Figure 4C:
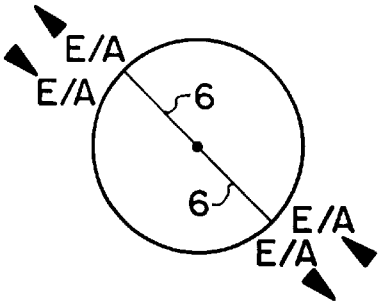

FIG. 4 shows some possibilities of arranging such combined entry/exit platforms E/A. In FIG. 4*a* three entry platforms E, three exit platforms A and an entry/exit platform E/A are provided for. The latter can be changed depending on traffic load, e.g. to entry platform at the beginning of business or performance and to exit platform at the ending. FIG. 4*b* shows a possible arrangement in a four-arm tender 5 and FIG. 4*c*—in a two-arm tender.

In case of large-scale plants and/or high frequency of entry and exit parking operations it is advisable to provide for two tenders 5. The two tenders therein can either be fixedly coupled with one another or displaceable by means of a common drive or they are operated independently from one another.

In case of two tenders independent from one another the building accommodating the plant can be built in arbitrary manner, e.g. overground or underground. The necessity of synchronous operation, however, already brings about an increased expense for control and a certain amount of loss in efficiency.

Two tenders independent from one another are advantageous in larger-scale plants in particular, in which part of the parking places is overground and the other part—underground. The one tender then serves the underground part and the other tender—the overground part. The entry and exit can therein be effected such that for each tender own entry and exit ramps and relating entry and exit platforms are provided for.

Figure 5A:
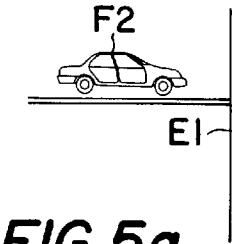
FIG. 5 shows the arrangement of a vehicle elevator with two tenders independent from one another.
Figure 5B:
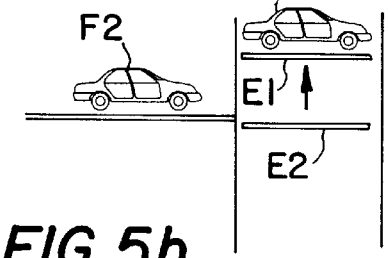
Figure 5C:
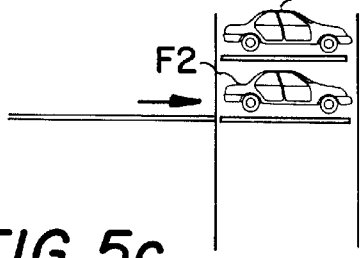
Figure 5D:
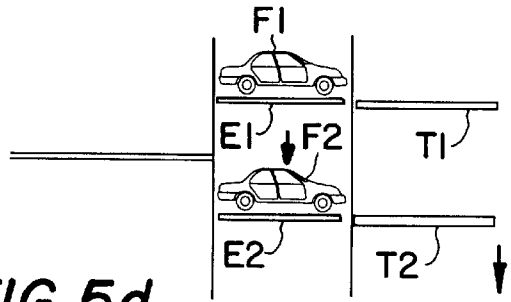
Figure 5E:
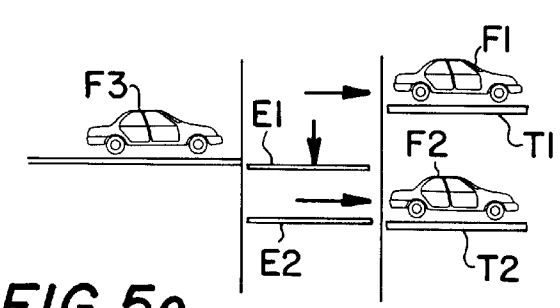

Another possibility lies in that a vehicle elevator by which the vehicles from a common entry are brought to the level of the respective tender or are brought back, respectively, to a common exit level is used as entry and exit platform. FIG. 5 shows such an arrangement having an entry 1, two entry platforms E1 and E2 built as vehicle elevator and movable in height independently, an upper tender T1 and a lower tender T2. In FIG. 5*a* a first vehicle F1 moved on the upper entry platform E1 and a second vehicle F2 is waiting in the entry 1. The upper entry platform E1 then is moved upwardly and the second vehicle F2 moves onto the lower entry platform E2 as shown in FIGS. 5*b* and 5*c*. The two entry platforms E1 and E2 then according to FIG. 5 are brought to the levels of the tenders T1 and T2 arranged one on top of the other in their end positions and are taken over by the transfer device of the carrier arms. After having taken over, the tenders move to a free parking place and the upper entry platform E1 is brought back to the level of the entry 1 for taking over the next waiting vehicle F3 (FIG. 5*e*). The entire operation simultaneously occurring on the exit side in reverse manner has a duration of 5 minutes approximately.

In the embodiment shown in FIG. 6, of the plant in accordance with the present invention all parking places 3 are located underground so that only a minimum in traffic space is required for approach and leaving. Above ground only at least one entry box EB and one exit box AB are provided for, from which a vehicle elevator leads to the underground transfer position.

The vehicle to be parked is positioned on the elevator in the entry box EB and by the elevator is brought up to the level of the tender which is in its uppermost position. There, it either is transferred to the entry platform E or the elevator itself is formed as entry platform from which the vehicle is taken over by means of the transfer device. On the exit side the course of action runs in correspondingly reverse direction.

This arrangement has the additional advantage that the exit box AB and the elevator located therein can be designed such that the vehicle can move out in forward direction. In case of the exit platforms in the above-described embodiment moving out only is possible in backward direction because of the specific design, this sometimes causing problems for unpracticed drivers.

FIG. 7 shows a further possibility for the embodiment of a tender 5 having two carrier arms 6. Corresponding to the arrows the vehicles can be taken over onto the carrier arms in forward direction and can again be delivered in the same direction so that the vehicles can leave the exit platform moving in forward direction.

The plant in accordance with the present invention can be equipped with some parking places for particularly high vehicles in a manner not shown here. The height of the vehicles is detected during entry e.g. by light barriers and vehicles with great height are brought to the parking places provided therefor by automatic control.

The invention being thus described, it will be obvious that the same may be varied in many ways. Such variations are not to be regarded as a departure from the spirit and scope of the invention, and all such modifications as would be obvious to one skilled in the art were intended to be included within the scope of the following claims.

I claim:

1. A system for receiving, temporarily storing, and delivering automobiles, the system comprising:

a cylindrical parking structure;

a plurality of parking platforms and a plurality of entry and exit platforms disposed within said parking structure, said plurality of entry platforms and said plurality of exit platforms being substantially equal in number, said parking platforms are disposed substantially below ground level while said entry and exit platforms are disposed substantially above ground level;

a helical running rail disposed in a center of said cylindrical parking structure, said parking platforms are spaced in an elevational manner adjacent to and outside said helical rail;

two tenders rotatably supported on a central frame structure within said helical running rail, said two tenders are spaced apart from each other along a center axis of said structure and are moveable independently of one another;

at least two vehicle support arms extend from each tender at positions which are symmetrically spaced relative to each other, each vehicle support arm contacts said helical rail; and at least two transmitter devices, each vehicle support arm supports each respective transmitter device, each transmitter device moves a vehicle across a surface of said vehicle support arm, said entry and exit platforms are disposed on a planar surface in a circular manner, said entry and exit platforms include at least a first group and a second group of entry and exit platforms, said first group includes at least one of an entry platform with an exit platform and two exit platforms; said second group includes at least one of an entry platform with an exit platform and two entry platforms; said platforms in each group are disposed at an acute angle relative to each other, said groups are disposed between 90 and 180 degrees relative to each other, whereby parking efficiency of a plurality of vehicles entering and exiting said structure per a unit of time is substantially increased.

2. The system of claim 1, wherein each tender includes at least four vehicle support arms extending from each tender at positions which are substantially 90 degrees relative to each other, each vehicle support arm contacts said helical rail.

3. The system of claim 1, wherein each tender includes at least three vehicle support arms extending from each tender at positions which are substantially 120 degrees relative to each other, each vehicle support arm contacts said helical rail.

4. The system of claim 1, wherein the number of said entry and exit platforms correspond to a multiple of the vehicle support arms.

5. The system of claim 1, wherein some of said entry and exit platforms have a dual function, wherein an entry platform functions as an exit platform while an exit platform functions as an entry platform.

* * * * *